US005820777A

United States Patent [19]

Schnur et al.

[11] Patent Number: 5,820,777

[45] Date of Patent: Oct. 13, 1998

[54] BLENDED POLYOL ESTER LUBRICANTS FOR REFRIGERANT HEAT TRANSFER FLUIDS

[75] Inventors: Nicholas E. Schnur, Cincinnati; Eugene R. Zehler, West Chester, both of Ohio

[73] Assignee: Henkel Corporation, Plymouth Meeting, Pa.

[21] Appl. No.: 785,569

[22] Filed: Jan. 21, 1997

Related U.S. Application Data

[63] Continuation of Ser. No. 515,635, Aug. 16, 1995, abandoned, which is a continuation of Ser. No. 29,204, Mar. 10, 1993, abandoned.

[51] Int. Cl.[6] ..... C09K 5/04

[52] U.S. Cl. ..... 252/68; 502/485; 502/506; 68/56; 68/84

[58] Field of Search ..... 252/68; 508/485, 508/506; 68/56, 84

[56] References Cited

U.S. PATENT DOCUMENTS

| | | | |
|---|---|---|---|
| Re. 19,265 | 8/1934 | Midgley et al. . | |
| 2,040,902 | 5/1936 | Zellhoefer . | |
| 2,084,950 | 6/1937 | Downing et al. | 62/114 |
| 2,187,388 | 1/1940 | Williams et al. | 252/68 |
| 2,520,612 | 8/1950 | Roberts et al. | 568/613 |
| 2,548,493 | 4/1951 | Robey | 560/190 |
| 2,575,195 | 11/1951 | Smith | 560/199 |
| 2,575,196 | 11/1951 | Smith | 560/154 |
| 2,628,974 | 2/1953 | Sanderson | 560/199 |
| 2,717,242 | 9/1955 | Foehr . | |
| 2,807,155 | 9/1957 | Williamitis | 62/502 |
| 2,852,470 | 9/1958 | Henne et al. | 252/68 |
| 2,926,139 | 2/1960 | Mott et al. . | |
| 2,958,706 | 11/1960 | Hurwitz et al. . | |
| 2,961,406 | 11/1960 | McNeil . | |
| 2,962,419 | 11/1960 | Minich . | |
| 3,135,785 | 6/1964 | Fritz . | |
| 3,189,629 | 6/1965 | Huttenlocher et al. . | |
| 3,194,791 | 7/1965 | Wilson et al. . | |
| 3,202,701 | 8/1965 | Young et al. . | |
| 3,282,971 | 11/1966 | Metro et al. | 554/227 |
| 3,309,318 | 3/1967 | Aylesworth et al. . | |
| 3,328,283 | 6/1967 | Godar . | |
| 3,328,285 | 6/1967 | Godar . | |
| 3,341,574 | 9/1967 | Taylor et al. . | |

(List continued on next page.)

FOREIGN PATENT DOCUMENTS

| | | |
|---|---|---|
| 252876 | 12/1960 | Australia . |
| 2022832 | 1/1990 | Canada . |
| 0089709A1 | 9/1983 | European Pat. Off. . |
| 195110 | 9/1986 | European Pat. Off. . |
| 0227477A2 | 7/1987 | European Pat. Off. . |
| 272575 | 6/1988 | European Pat. Off. . |
| 315069 | 5/1989 | European Pat. Off. . |
| 336171 | 10/1989 | European Pat. Off. . |
| 406479 | 10/1989 | European Pat. Off. . |
| 479338 | 10/1989 | European Pat. Off. . |
| 0359071A1 | 3/1990 | European Pat. Off. . |
| 0377122A1 | 7/1990 | European Pat. Off. . |
| 378176 | 7/1990 | European Pat. Off. . |
| 379175 | 7/1990 | European Pat. Off. . |
| 0384724A1 | 8/1990 | European Pat. Off. . |
| 430657 | 11/1990 | European Pat. Off. . |
| 440069 | 1/1991 | European Pat. Off. . |
| 445610 | 2/1991 | European Pat. Off. . |
| 445611 | 2/1991 | European Pat. Off. . |
| 415778 | 3/1991 | European Pat. Off. . |
| 448402 | 3/1991 | European Pat. Off. . |
| 458584 | 5/1991 | European Pat. Off. . |
| 435253 | 7/1991 | European Pat. Off. . |
| 0440069A1 | 8/1991 | European Pat. Off. . |

(List continued on next page.)

OTHER PUBLICATIONS

Synthetic Lubricants (Ch. 10, Neopentyl Polyol Esters); Smith, Thomas; 1962; Midland, Michigan (Month Unknown).

Complex Esters of 2,2–Dimethylhydracrylic Acid; Lederle, Henry F.; New Haven, CT; Mar. 1969.

Grant & Hackh's Chemical Dictionary 5th Edition; 1987, pp. 11 and 284, (Month Unknown).

Hawley's Condensed Chemical Dictionary 11th Edition; 1987, p. 214 (Month Unknown).

H.H. Kruse and M. Schroeder, "Fundamentals of Lubrication in Refrigerating Systems and Heat Pumps", ASHRAE Transactions, vol. 90, Part 2B, KC–84–14, p. 763, Kansas City, Missouri, 1984. (Month Unknown).

A. Al'tman et al., "Synthetic Lubricant", Translation of Russian Patent No. 208868 (Application No. 1028071/23–4), Sep. 18, 1965.

K. Sandvordenker et al., "A Review of Synthetic Oils for Refrigeration Use", ASHRAE Symposium Bulletin NA–72–5, Nassau, Bahamas (Date Unknown).

Chemical Abstract, vol. 96 71653H, May 2, 1979.

K. Sandvordenker, "Materials Compatibility of R134S in Refrigerant Systems", CFCS: Time of Transition, American Society of Heating, Refrigerating and Air–Conditioning Engineers, Inc., pp. 211–216, Jan. 1989.

Mobil Chemical, "Ester Base Stock", Data Sheets for Mobil Esters P41 and P51, Date Unknown.

Neopentyl Polyol Ester Lubricants–Bulk Property Optimization; Niedzielski, Edmund; Ind. Eng. Chem., Prod. Res. Dev., vol. 15 No. 1, 1976.

Lubricants and Related Products, pp. 122–125; Klamann, Dieter; 1984 (Month Unknown).

(List continued on next page.)

*Primary Examiner*—Alan Diamond

*Attorney, Agent, or Firm*—Wayne C. Jaeschke; Norvell E. Wisdom, Jr.; John S. Child, Jr.

[57] ABSTRACT

From not more than three blending stocks, it is possible to prepare a wide variety of mixtures of esters of hindered polyhydric alcohols that are especially valuable lubricants for chlorine-free fluorocarbon refrigerant heat transfer fluids, particularly Refrigerant 134a (1,1,1,2-tetrafluoroethane).

21 Claims, No Drawings

U.S. PATENT DOCUMENTS

| | | | |
|---|---|---|---|
| 3,441,600 | 4/1969 | Chao et al. | 560/263 |
| 3,523,084 | 8/1970 | Chao et al. . | |
| 3,560,387 | 2/1971 | Schritt . | |
| 3,562,300 | 2/1971 | Chao et al. | 554/165 |
| 3,564,044 | 2/1971 | Chao et al. | 560/263 |
| 3,694,382 | 9/1972 | Kleiman et al. . | |
| 3,773,668 | 11/1973 | Denis et al. . | |
| 3,778,454 | 12/1973 | Kleiman et al. . | |
| 3,850,824 | 11/1974 | Nebzydoski et al. . | |
| 3,878,112 | 4/1975 | Luck et al. . | |
| 3,894,959 | 7/1975 | Gardiner et al. . | |
| 3,939,201 | 2/1976 | Bacskai | 560/263 |
| 4,045,376 | 8/1977 | Rubin et al. . | |
| 4,049,563 | 9/1977 | Burrous . | |
| 4,053,491 | 10/1977 | Koch et al. . | |
| 4,113,642 | 9/1978 | Koch et al. . | |
| 4,144,183 | 3/1979 | Koch et al. . | |
| 4,155,861 | 5/1979 | Schmitt et al. . | |
| 4,159,255 | 6/1979 | Gainer et al. . | |
| 4,175,045 | 11/1979 | Timony . | |
| 4,178,261 | 12/1979 | Dhein et al. . | |
| 4,199,461 | 4/1980 | Olund . | |
| 4,212,816 | 7/1980 | Hentschel et al. | 554/227 |
| 4,234,497 | 11/1980 | Honig | 554/172 |
| 4,243,540 | 1/1981 | Mancini et al. . | |
| 4,248,726 | 2/1981 | Uchinuma et al. . | |
| 4,263,159 | 4/1981 | Berens et al. . | |
| 4,267,064 | 5/1981 | Sasaki et al. . | |
| 4,292,187 | 9/1981 | Hentschel et al. . | |
| 4,302,343 | 11/1981 | Carswell et al. . | |
| 4,304,678 | 12/1981 | Schick et al. . | |
| 4,320,018 | 3/1982 | Yaffe . | |
| 4,324,676 | 4/1982 | Gilbert . | |
| 4,359,394 | 11/1982 | Gainer et al. . | |
| 4,371,577 | 2/1983 | Sato et al. . | |
| 4,428,854 | 1/1984 | Enjo et al. . | |
| 4,431,557 | 2/1984 | Shimazu et al. . | |
| 4,440,660 | 4/1984 | van Rijs et al. . | |
| 4,454,052 | 6/1984 | Shoji et al. . | |
| 4,455,247 | 6/1984 | Nakayama et al. . | |
| 4,487,874 | 12/1984 | Lindner . | |
| 4,530,772 | 7/1985 | Timony . | |
| 4,557,850 | 12/1985 | Ando et al. . | |
| 4,559,154 | 12/1985 | Poweli . | |
| 4,719,025 | 1/1988 | Akiyama et al. . | |
| 4,751,012 | 6/1988 | Ward et al. . | |
| 4,755,316 | 7/1988 | Magid et al. | 252/68 |
| 4,758,366 | 7/1988 | Parekh . | |
| 4,780,229 | 10/1988 | Mullin . | |
| 4,812,262 | 3/1989 | Shinzawa et al. . | |
| 4,826,633 | 5/1989 | Carr et al. . | |
| 4,851,144 | 7/1989 | McGraw et al. . | |
| 4,900,463 | 2/1990 | Thomas et al. . | |
| 4,927,554 | 5/1990 | Jolley et al. . | |
| 4,938,887 | 7/1990 | Grava et al. . | |
| 4,941,986 | 7/1990 | Jolley . | |
| 4,944,890 | 7/1990 | Deeb et al. . | |
| 4,948,525 | 8/1990 | Sasaki et al. . | |
| 4,959,169 | 9/1990 | McGraw et al. | 252/68 |
| 4,963,282 | 10/1990 | Jolley et al. . | |
| 4,992,188 | 2/1991 | Jolley . | |
| 5,008,028 | 4/1991 | Jolley et al. | 252/68 |
| 5,021,179 | 6/1991 | Zehler et al. | 252/68 |
| 5,021,180 | 6/1991 | McGraw . | |
| 5,023,007 | 6/1991 | Grava et al. | 252/67 |
| 5,032,305 | 7/1991 | Kamakura et al. | 252/68 |
| 5,032,306 | 7/1991 | Cripps | 252/68 |
| 5,053,155 | 10/1991 | Mahler | 252/68 |
| 5,057,247 | 10/1991 | Schmid et al. . | |
| 5,061,550 | 10/1991 | Shimizu et al. . | |
| 5,080,816 | 1/1992 | Sakamoto et al. . | |
| 5,096,606 | 3/1992 | Hagihara et al. | 252/68 |
| 5,137,650 | 8/1992 | Kaneko . | |
| 5,158,698 | 10/1992 | Jolley et al. . | |
| 5,185,092 | 2/1993 | Fukuda et al. | 508/440 |
| 5,202,044 | 4/1993 | Hagihara et al. . | |
| 5,211,884 | 5/1993 | Bunemann et al. . | |
| 5,262,076 | 11/1993 | Ishida et al. . | |
| 5,273,410 | 12/1993 | Kitaichi et al. . | |
| 5,290,465 | 3/1994 | Sabahi . | |
| 5,310,492 | 5/1994 | Seiki et al. . | |
| 5,354,486 | 10/1994 | Evan . | |
| 5,391,313 | 2/1995 | Antika et al. . | |

FOREIGN PATENT DOCUMENTS

| | | |
|---|---|---|
| 0449406A1 | 10/1991 | European Pat. Off. . |
| 0452509A1 | 10/1991 | European Pat. Off. . |
| 0458584A1 | 11/1991 | European Pat. Off. . |
| 458584 | 11/1991 | European Pat. Off. . |
| 0461262B1 | 12/1991 | European Pat. Off. . |
| 522167 | 12/1991 | European Pat. Off. . |
| 468729 | 1/1992 | European Pat. Off. . |
| 480479 | 4/1992 | European Pat. Off. . |
| 498152 | 8/1992 | European Pat. Off. . |
| 499994 | 8/1992 | European Pat. Off. . |
| 0536814A1 | 4/1993 | European Pat. Off. . |
| 2302290 | 10/1976 | France . |
| 2154524 | 2/1981 | France . |
| 2943446 | 5/1980 | Germany . |
| 2943446A1 | 3/1989 | Germany . |
| 133966 | 7/1989 | Germany . |
| 1768765 | 4/1991 | Germany . |
| 4105956 | 8/1992 | Germany . |
| 53-136170 | 11/1978 | Japan . |
| 54-040260 | 3/1979 | Japan . |
| 55-145638 | 11/1980 | Japan . |
| 55-155093 | 12/1980 | Japan . |
| 56-36570 | 4/1981 | Japan . |
| 57-078475 | 5/1982 | Japan . |
| 58-15592 | 1/1983 | Japan . |
| 59-027979 | 2/1984 | Japan . |
| 59-029625 | 2/1984 | Japan . |
| 59-21632 | 2/1984 | Japan . |
| 59-164393 | 9/1984 | Japan . |
| 61-62596 | 3/1986 | Japan . |
| 53-143609 | 12/1987 | Japan . |
| 62-290795 | 12/1987 | Japan . |
| 485396 | 3/1992 | Japan . |
| 96079 | 4/1962 | Romania . |
| 208868 | 7/1968 | U.S.S.R. . |
| 1057526 | 11/1983 | U.S.S.R. . |
| 644597 | 10/1950 | United Kingdom . |
| 662650 | 12/1951 | United Kingdom . |
| 760490 | 10/1956 | United Kingdom . |
| 889067 | 2/1962 | United Kingdom . |
| 892943 | 4/1962 | United Kingdom . |
| 894639 | 4/1962 | United Kingdom . |
| 1028402 | 5/1966 | United Kingdom . |
| 1460665 | 2/1974 | United Kingdom . |
| 2216541 | 10/1989 | United Kingdom . |
| 9005831 | 6/1987 | WIPO . |
| WO8808023 | 10/1988 | WIPO . |
| WO90/12849 | 11/1990 | WIPO . |
| WO9105831 | 5/1991 | WIPO . |
| WO9201030 | 1/1992 | WIPO . |
| WO9311210 | 6/1993 | WIPO . |

OTHER PUBLICATIONS

Synthetic Ester Lubricants; Barnes, R.S. et al.; Lubrication Engineering; Aug. 1957.

New Type Lube Oil for HFC–134a Compressor System; Takeno, T. et al.; 1992 (Month Unknown).
Abstract 17463, Disclosed by Petrochemicals Dept. EI du Pont de Nemours & Co. (Date Unknown).
Chemical Abstract, vol. 102 No. 2, p. 166, Jan. 1985.
European Search Report.
Predicting Behavior of Oils in Refrigeration Systems:, Bosworth, C.M., Refrigerating Engineering, Jun. 1952.
Synthetic Lubricants and Their Refrigeration applications, Short, Glenn D. Presented at the 44th Annual Meeting of the Society of Tribologists and Lubrication Engineers, Atlanta, Georgia, May 1–4, 1989, pp. 1–9.
Diester Compressor Oils in Refrigeration, Fluid & Lubrication Ideas, Fall, 1979 pp. 25, 26 (Month Unknown).
CA 110:215912z Synthetic Oil For Use With R–22 and R–502 Cooling Agents Texhnol. Topl. Mosel (1989) (Month Unknown).
CA 104:227382r Synthetic Lubricants for Regrigeration Systems, Seto, Kazuki (Matsumora Oil Co. Ltd., Japan) REITO 1985 69(694) 802–9 (Month Unknown).

Evaluation of Lubricants for Refrigeration and Air–Condition Compressors, Spauschus, Hans O. Cite Ashrae Transactions 90 (Pt. 2B): 784–798 (1984) (Month Unknown).

Certificates of Analyses numbered 1–35. The Certificates of Analyses pertain to "E32" with non relevant material blanked out. The 35 Certificates of Analyses relate to activities and shipments of material more than one year prior to Jul. 12, 1990, the filing date of U.S. Ser. No. 551,969, which issued as U.S. Patent 5,021,179 to Zehler et al. Each Certificate of Analyses bears a date more than one year prior to Jul. 12, 1990. Actual Date Unknown for publication.

BLENDED POLYOL ESTER LUBRICANTS FOR REFRIGERANT HEAT TRANSFER FLUIDS

CROSS-REFERENCE TO RELATED APPLICATION

This application is a continuation of application Ser. No. 08/515,635 filed on Aug. 16, 1995, now abandoned which is a continuation of application Ser. No. 08/029,204 filed on Mar. 10, 1993, now abandoned which is a continuation-in-part of application Ser. No. PCT/US92/04438 filed on Jun. 3, 1992. The entire disclosure of PCT/US92/04438, except to the extent contrary to any explicit statement herein, is hereby incorporated herein by reference.

BACKGROUND OF THE INVENTION

1. Field of the Invention

This invention relates to lubricant base stocks, which can also serve as complete lubricants in some cases; compounded lubricants, which include at least one additive for such purposes as improving high pressure and/or wear resistance, corrosion inhibition, and the like along with the lubricant base stocks which contribute the primary lubricity to the lubricants; refrigerant working fluids including lubricants according to the invention along with primary heat transfer fluids; and methods for using these materials. The lubricants and lubricant base stocks are generally suitable for use with most or all halocarbon refrigerants and are particularly suitable for use with substantially chlorine-free, fluoro-group-containing organic refrigerating heat transfer fluids such as pentafluoroethane, 1,1-difluoroethane, 1,1,1-trifluroethane, and tetrafluoroethanes, most particularly 1,1,1,2-tetrafluoroethane.

2. Statement of Related Art

Chlorine-free heat transfer fluids are desirable for use in refrigerant systems, because their escape into the atmosphere causes less damage to the environment than the currently most commonly used chlorofluorocarbon heat transfer fluids such as trichlorofluoromethane and dichlorodifluoromethane. The widespread commercial use of chlorine-free refrigerant heat transfer fluids has been hindered, however, by the lack of commercially adequate lubricants. This is particularly true for one of the most desirable working fluids, 1,1,1,2-tetrafluoroethane, commonly known in the art as "Refrigerant 134a" or simply "R134a". Other fluoro-substituted ethanes are also desirable working fluids.

The following patents and published patent applications also teach many general classes and specific examples of polyol esters as useful refrigerant lubricants with chlorine-free fluoro group containing heat transfer fluids: U.S. Pat. No. 4,851,144; UK 2 216 541; U.S. Pat. No. 5,021,179; U.S. Pat. No. 5,096,606; WO 90/12849 (Lubrizol); EP 0 406 479 (Kyodo Oil); EP 0 430 657 (Asahi Denka KK); EP 0 435 253 (Nippon Oil); EP 0 445 610 and 0 445 611 (Hoechst AG); EP 0 449 406 (Tonen Corp.); EP 0 458 584 (Unichema Chemie BV); and EP 0 485 979 (Hitachi).

DESCRIPTION OF THE INVENTION

Except in the claims and the operating examples, or where otherwise expressly indicated, all numerical quantities in this description indicating amounts of material or conditions of reaction and/or use are to be understood as modified by the term "about" in defining the broadest scope of the invention. Practice of the invention within the boundaries corresponding to the exact quantities stated is usually preferable, however.

A wide variety of viscosities and other physical and chemical properties are needed to achieve optimal effectiveness of lubricants in the many different types of refrigeration equipment in practical use.

For example, home refrigerators of the normal type generally are required to maintain cool temperatures within a relatively small and well insulated space, and the temperature of their environment, to which waste heat must be discharged, does not normally vary over a wide range, because it usually is a temperature in which humans can be reasonably comfortable. Therefore, relatively low power compressors are generally employed for such normal home refrigerators, and lubricants with relatively low viscosities at normal human comfort temperatures are generally satisfactory, because the environmental temperature never rises very high, so that any drastic decrease in viscosity of the lubricant with temperature is largely avoided. Under such conditions, low viscosity lubricants are preferred for economy of operation, because with all other factors held equal, a low viscosity lubricant reduces power consumption by the lubricated machinery, and, with the rising cost of electric power, consumers are becoming more sensitive to efficiency in their home appliances.

On the other hand, an automobile air conditioner may easily be exposed to an outdoor temperature of −20° C. or less in winter in a normal temperate zone continental climate, while in summer it must discharge heat to an environment inside the engine compartment of the automobile that may reach a much higher temperature than would ever be encountered in the environment of a home refrigerator in normal use. Therefore, a lubricant with the viscosity preferred for a high efficiency home refrigerator would have too low a viscosity at summer operating temperatures to be an effective lubricant in most automotive air conditioner applications. Refrigeration equipment for large scale industrial use or commercial use, such as in an ice-making plant or a large facility for quick freezing food, because of the high mechanical power needed, usually requires a lubricant with even more viscosity than that needed for an automotive air conditioner. Also, screw compressors generally need higher viscosity lubricants than reciprocating compressors of the same capacity.

Esters of hindered polyols, which are defined for this purpose as organic molecules containing at least five carbon atoms, at least 2 —OH groups, and no hydrogen atoms bonded directly to any carbon atom that is directly bonded to a carbon atom bearing an —OH group, have already been recognized in the art as high quality lubricant basestocks for almost any type of refrigeration machinery employing a fluorocarbon refrigerant, particularly one free from chlorine. The approach of the prior art has generally been to provide for each particular class of lubricant service a single type of polyol ester, or a mixture of such esters made by a single step reaction between one or more hindered polyols and one or more acids. This approach is capable of providing satisfactory performance, but it has the disadvantage that a wide variety of individual mixtures is required to cover all the wide variety of conditions of service as already noted.

Under the laws of many countries, any new chemical has to be tested for safety before it can legally be sold for general use, and any material made by reacting new mixtures of ingredients is usually defined as a new chemical. Therefore, every distinct mixture of polyol esters made by a single step reaction is likely to have to be tested and registered by several government agencies, at very substantial expense for each such distinct mixture, in order to be legally sold in all advanced countries with laws requiring such registration.

On the other hand, mechanical mixtures of previously registered chemicals are often exempted from legal requirements for registration, or at least subjected to less extensive, and therefore less expensive, testing than is required for mixtures legally defined as new chemicals. There is therefore a technical and economic incentive to provide lubricant base stocks suitable for most or all of the wide variety of conditions of lubricant service by blending from the smallest possible number of chemical components.

It has now been found that high quality lubricants with a very wide variety of viscosity grades can be obtained by blending at least two of only three carefully selected types of blending stock polyol esters.

The first of these three types ("Type 1"), with the lowest viscosity of the three, is an ester or mixture of esters made by reacting (i) a mixture of alcohol molecules consisting of molecules selected from the group consisting of 2,2-dimethylpropane-1,3-diol (also called "neopentyl glycol" and often abbreviated hereinafter as "NPG"), 2,2-dimethylol-1-butanol (also called "trimethylolpropane" and often abbreviated hereinafter as "TMP"), 2,2-dimethylol-1-propanol (also called "trimethylol ethane" and often abbreviated hereinafter as "TME"), and 2,2-dimethylolpropane-1,3-diol (also called "pentaerythritol" and often abbreviated hereinafter as "PE") with (ii) a mixture of acid molecules in which at least 75% of the molecules are selected from the group consisting of butanoic acid, 2-methylpropanoic acid, pentanoic acid, 2-methylbutanoic acid, and 3-methylbutanoic acid and the balance of the acid molecules are selected from the group consisting of other monobasic straight chain carboxylic acids with not more than six carbon atoms and other monobasic branched chain carboxylic acids with not more than nine carbon atoms. (Of course, for this and all the other types of esters described herein as part of the invention, it is possible to obtain the same esters or mixture of esters by reacting acid derivatives such as acid anhydrides, acyl chlorides, and esters of the acids with lower molecular weight alcohols than those desired in the ester products according to this invention, instead of reacting the acids themselves. The acids are generally preferred for economy and are normally specified herein, but it is to be understood that the esters defined herein by reaction with acids can be equally well obtained by reaction of alcohols with the corresponding acid derivatives.)

For this and all the other types of esters described herein as part of the invention, it is to be understood that only the desired alcohols and acids are explicitly specified, but some amount of the sort of impurities normally present in commercial or industrial grade products can be tolerated in most cases. For example, "commercial di-pentaerythritol" normally contains only about 82–90 mole % of pure di-pentaerythritol, along with 5–9 mole % of tri-pentaerythritol, and 5–9 mole % of PE, and it is quite satisfactory for making high viscosity esters in many cases. (Di-pentaerythritol, often abbreviated hereinafter as "DPE", is a molecule with six hydroxyl groups and one ether bond, formally derived from two PE molecules by removing one hydroxyl group from one of the PE molecules and one hydrogen atom from a hydroxyl group of the other PE molecule to form water and join the two remainders of the original PE molecules with an ether bond. Tri-pentaerythritol, often abbreviated hereinafter as "TPE", is a molecule with eight hydroxyl groups and two ether bonds, formally derived from three PE molecules by an analogous elimination of the elements of two molecules of water as described above, for elimination of a single water molecule, for DPE.)

In general, however, it is preferred, with increasing preference in the order given, that not more than 25, 21, 17, 12, 8, 5, 3, 2, 1, 0.5, or 0.2% of either the hydroxyl groups in the alcohol mixtures specified herein or of the carboxyl groups in the acid mixtures specified herein should be part of any molecules other than those explicitly specified for each type of blending stock. Percentages of specific chemical molecules or moieties specified herein, such as the percentages of carboxyl and hydroxyl groups stated in the preceding sentence, are to be understood as number percentages, which will be mathematically identical to percentages by chemical equivalents, with Avogadro's number of each specified chemical moiety regarded as a single chemical equivalent.

With increasing preference in the order given, at least 45, 62, 78, 89, or 95% of the alcohol molecules reacted to make the Type 1, lowest viscosity, ester blending stock to be used according to this invention are TMP, PE, or a mixture thereof. With increasing preference in the order given, at least 51, 67, 85, 92, 97, or 99% of the acid molecules reacted to make the Type 1 ester blending stock are selected from acids containing five carbon atoms per molecule, and independently, with increasing preference in the order given, at least 60, 72, 84, 93, or 97% of the total of the five carbon acid molecules in this acid component consist of pentanoic acid (straight chain).

These preferences were determined by taking into account a wide variety of factors determined empirically, including the following generalizations: Branched acids give esters with a lower viscosity index, but with usually higher absolute viscosities at normal ambient human comfort temperatures or any lower temperature, than unbranched acids with the same number of carbon atoms. Alcohols with two hydroxyl groups yield esters with lower viscosities than those with three hydroxyl groups. Acids with six or more carbon atoms yield esters with more viscosity than those with fewer carbon atoms, and acids with four or, especially, fewer than four, carbon atoms are substantially more easily hydrolyzed during use than those with higher numbers of carbon atoms; such hydrolysis is disadvantageous, because the acid produced by hydrolysis promotes damaging corrosion of at least some of the types of metal surfaces normally being lubricated. Also, the corrosiveness of a carboxylic acid to most metals found in refrigerator compressors increases as the number of carbon atoms in the acid molecule decreases.

As a result of these various factors, the esters of TMP and/or PE with pentanoic acid have been found to be close to ideal as low viscosity blending stocks, because they are about as low in viscosity as is ever normally desirable for existing refrigerating machinery, are miscible in all proportions with most or all fluorocarbon refrigerants over a temperature range of at least −55° C. up to at least the boiling point of the fluorocarbon refrigerant at normal atmospheric pressure and often to still higher temperatures which can easily be reached in the compression stage of a refrigerator, are capable of solubilizing other higher viscosity and less soluble hindered polyol esters, are very effective in reducing the viscosity of the other types of blending stock with which they may be mixed, and are substantially less likely than esters of acids with fewer than five carbon atoms per molecule to promote corrosion.

The second type of blending stock according to this invention ("Type 2"), one with an intermediate viscosity range, is an ester or mixture of esters made by reacting (i) a mixture of alcohol molecules selected from the group consisting of TMP; di-trimethylolpropane (often abbreviated hereinafter as "DTMP"), a molecule with four hydroxyl groups and one ether linkage, formally derived from two molecules of TMP by removing one hydroxyl group from one of the TMP molecules and one hydrogen atom from a hydroxyl group of the other TMP molecule to form water and join the two remainders of the original TMP molecules with an ether bond; PE; and DPE, with (ii) a mixture of acid molecules selected from the group consisting of all the straight and branched chain monobasic and dibasic carboxylic acids with from four to twelve carbon atoms each, with the constraints that (a) a total of at least 3%, or, with increasing preference in the order given, at least 7, 10, 14, 21, or 28%, of the acid molecules in the mixture are molecules of 2-methylbutanoic and/or 3-methylbutanoic acids, which are jointly abbreviated hereinafter as "i-$C_5$ acid"; (b) the ratio of the % of acid molecules in the mixture that contain 8 or more carbon atoms and are unbranched to the % of acid molecules in the mixture that are both branched and contain not more than six, preferably not more than five, carbon atoms is not greater than 1.56, more preferably not greater than 1.21, or still more preferably not greater than 1.00; (c) the % of acid molecules in the mixture that contain at least nine carbon atoms, whether branched or not, is not greater than 81, or increasingly more preferably, not greater than 67 or 49; and (d) either (d)(1) a total of at least 20, or, with increasing preference in the order given, at least 29, 35, or 41% of the acid molecules in the mixture are selected from the trimethylhexanoic acids, or most preferably are 3,5,5-trimethylhexanoic acid; not more than 14, or, with increasing preference in the order given, not more than 10, 7, 3, 1, or 0.4% of the carboxyl groups in the acid mixture are part of dibasic acids; and not more than 2, more preferably not more than 1, or still more preferably not more than 0.5, % of the carboxyl groups in the acid mixture are part of acid molecules with more than two carboxyl groups each; or (d)(2) at least 3, or with increasing preference in the order given, at least 5, 7, 10, or 14%, but not more than 18%, of the carboxyl groups in the acid mixture are part of dibasic acid molecules; not more than 2, more preferably not more than 1, or still more preferably not more than 0.5, % of the carboxyl groups in the acid mixture are part of acid molecules with more than two carboxyl groups each; and a total of at least 82, or with increasing preference in the order given, at least 85, 89, 93, 96, or 99% of the monobasic acid molecules in the acid mixture have either five or six, or more preferably exactly five, carbon atoms each.

Preferably, in the mixtures reacted to make this Type 2 blending stock, with increasing preference in the order given, at least 60, 75, 85, 90, 95, or 98% of the hydroxyl groups in the mixture are part of PE molecules. Independently, in the mixtures reacted to make the Type 2 blending stock, with increasing preference in the order given, at least 60, 75, 85, 90, 95, or 98% of the monobasic acid molecules in the acid mixture consist of molecules having no more than ten carbon atoms each and, with increasing preference in the order given, at least 60, 75, 85, 90, 95, or 98% of the dibasic acid molecules in the acid mixture consist of molecules having no more than ten carbon atoms each, or more preferably from five to seven carbon atoms each. Most preferably, with increasing preference in the order given, a total of at least 60, 75, 85, 90, 95, or 98% of the monobasic acid molecules in the acid mixture consist of molecules having either exactly five or exactly nine carbon atoms each.

As with the Type 1 blending stock, these preferences for the Type 2 blending stock are based on empirically determined generalizations. In order to achieve the desired middle range of viscosity, corresponding at least approximately to ISO grades 32–46, it is advantageous to have a substantial fraction of alcohols with at least four hydroxyl groups. Among the commercially available hindered alcohols that satisfy this criterion, PE is less expensive than DTMP and is free from the ether linkage in DTMP, which increases the hygroscopicity of the esters formed and thereby may promote undesirable corrosion of the metal surfaces lubricated. Alcohols with more than four hydroxyl groups produce esters with higher than optimum viscosities, but some such esters can be tolerated, and mixtures including them may be cheaper. Commercial grade PE often contains a substantial amount of DPE, and costs at least a little less than more purified PE. When cost factors are not severely constraining, removing most or all of the DPE from a predominantly PE mixture of alcohols used to make the esters is preferable, in order to minimize the chance of insolubility of part of the ester mixture at low temperatures.

In order to obtain Type 2 esters with adequate viscosity, a considerable fraction of the acid molecules reacted need to have eight or more carbon atoms or be dibasic. Dibasic acids are less desirable. They must be used, if at all, in rather small amounts in order to avoid excessive viscosity, because of the capability of forming very high molecular weight and very viscous oligomers or polymers by reaction between alcohol and acid molecules that both have at least two functional groups. In practice, it has been found that the amount of dibasic acid that can be effectively used in the acid mixture reacted to make a Type 2 blending stock used according to this invention is substantially less than the amount that would be sufficient to provide at least one dibasic acid group to link each two alcohol molecules in the alcohol mixture also reacted. Therefore, when such amounts of dibasic acid are used, some of the alcohol molecules will be joined together in the esters formed and some will not; the esters with two or more alcohol moieties will be much more viscous and normally less readily soluble in the fluorocarbon refrigerant fluids than the other esters in the mixture, those with only one alcohol moiety, thereby increasing the risk of undesirable phase separation in the course of use of the esters.

When substantially only monobasic acids are used to make the esters in the Type 2 blending stock, as already noted, in order to obtain adequate viscosity in the mixture, a substantial fraction of the acid molecules must have at least eight carbon atoms. With acids of such length, solubility in the fluorocarbon refrigerant fluids is less than for esters with shorter acids, and this reduced solubility is particularly marked for straight chain acids, sb that a substantial fraction of the longer acids normally needs to be branched; alternatively, it has been found that these longer straight chain acids can be "balanced" for solubility with an equal or not too much less than equal fraction of branched acids with five or six carbon atoms. When the number of carbon atoms per molecule is nine or more, not even branching is sufficient to produce adequate solubility by itself, so that an upper limit on the fraction of such acids is independently required. In general, a minimum amount of the particularly advantageous i-$C_5$ acid is specified to aid in solubilizing the parts of the esters in the mixture that contain dibasic acids or those with eight or more carbon atoms.

For both performance and economic reasons, it has been found that five and nine carbon monobasic acids are the most preferred constituents, and they are very effective in balancing each other to achieve a mix of viscosity and solubility characteristics that is better suited than others to most applications. Trimethylhexanoic acids, with their three methyl branches, produce the most soluble esters among the readily available nine carbon acids. (In general, methyl branches are the most effective in promoting solubility without increasing viscosity excessively, because of the larger number of carbon atoms in other branching groups.) Branches on the carbon alpha to the carboxyl increase the difficulty of esterification and do not appear to be any more effective in increasing solubility than more remotely located branches. The most economical commercially available mixture of branched nine carbon acids, which contains from 88–95 mole % of 3,5,5-trimethylhexanoic acid with all but at most 1 mole % of the remainder being other branched $C_9$ monobasic acids, appears at least as effective as any other and is therefore preferred for economic reasons as the source of $C_9$ monobasic acids.

The third, highest viscosity, blending stock ester or ester mixture ("Type 3") to be used according to this invention is made by reacting (i) a mixture of alcohol molecules selected from the group consisting of TMP; DTMP; PE; DPE; TPE; and tri-trimethylolpropane (hereinafter often abbreviated as "TTMP"), a molecule with five hydroxyl groups and two ether bonds, formally derived from three TMP molecules by elimination of the elements of two molecules of water as described above for TPE, with (ii) a mixture of acid molecules selected from the group consisting of all the straight or branched chain monobasic carboxylic acids with five or six carbon atoms each, the singly or multiply branched chain monobasic carboxylic acids with from seven to thirteen carbon atoms each, and the dibasic carboxylic acids with four to ten carbon atoms each, subject to one of the groups of constraints (a) that (a)(1) at least 19%, or, with increasing preference in the order given, at least 23, 27, 29, or 33%, of the carboxyl groups in the acid mixture are part of dibasic acid molecules, (a)(2) at least 75%, or, with increasing preference in the order given, at least 82, 89, 95, or 98% of the carboxyl groups in the acid mixture that are part of monobasic acid molecules are part of monobasic acid molecules with five carbon atoms each, and (a)(3) the % of the carboxyl groups in the acid mixture that are part of an i-$C_5$ acid is at least 34, or with increasing preference in the order given, at least 45, 57, 70, 85, 93, 108, 119, 130, or 135, % of the % of the carboxyl groups in the acid mixture that are part of dibasic acid molecules; or (b) that (b)(1) not more than 14, or, with increasing preference in the order given, not more than 10, 7, 3, 1, or 0.4% of the carboxyl groups in the acid mixture are part of dibasic acids; (b)(2) at least 82, or, with increasing preference in the order given, at least 84, 88, 92, or 96, % of the carboxyl groups in the acid mixture are part of monobasic acids containing at least nine carbon atoms and at least one branch; and (b)(3) at least 60, or, with increasing preference in the order given, at least 71, 84, 88, 92, or 96, % of the carboxyl groups in the acid mixture are part of trimethyl hexanoic acid molecules, most preferably part of 3,5,5-trimethylhexanoic acid molecules.

Preferably, in the mixtures reacted to make the Type 3 blending stock, with increasing preference in the order given, at least 60, 75, 85, 90, 95, or 98% of the hydroxyl groups in the mixture are part of PE or DPE molecules, and of these, at least 50, more preferably at least 66, or still more preferably at least 80, % are PE molecules.

The above descriptions for each of the acid and alcohol mixtures reacted to produce one of the three hindered polyol ester blending stocks refers only to the mixture of acids or alcohols that actually reacts to form esters and does not necessarily imply that the mixtures of acids or alcohols contacted with each other for the purpose of reaction will have the same composition as the mixture that actually reacts. In fact, it has been found that reaction between the alcohol(s) and the acid(s) used proceeds more effectively if the quantity of acid charged to the reaction mixture initially is enough to provide an excess of 10–25% of equivalents of acid over the equivalents of alcohol reacted with the acid. (An equivalent of acid is defined for the purposes of this specification as the amount containing one gram equivalent weight of carboxyl groups, while an equivalent of alcohol is the amount containing one gram equivalent weight of hydroxyl groups.) If the acid component reacted contains both monovalent and higher valent acids, the excess preferably is made up of monovalent acids alone. The composition of the mixture of acids that actually reacted can be determined by analysis of the product ester mixture for its acyl group content.

In making most or all of the esters and mixtures of esters preferred for use as blending stocks according to this invention, the acid(s) reacted will be lower boiling than the alcohol(s) reacted and the product ester(s). When this condition obtains, it is preferred to remove the bulk of any excess acid remaining at the end of the esterification reaction by distillation, most preferably at a low pressure such as 1–5 torr.

After such vacuum distillation, the product is often ready for use as a lubricant blending stock according to this invention. If further refinement of the product is desired, the content of free acid in the product after the first vacuum distillation may be further reduced by treatment with epoxy esters as taught in U.S. Pat. No. 3,485,754 or by neutralization with any suitable alkaline material such as lime, alkali metal hydroxide, or alkali metal carbonates. If treatment with epoxy esters is used, excess epoxy ester may be removed by a second distillation under very low pressure, while the products of reaction between the epoxy ester and residual acid may be left behind in the product without harm. If neutralization with alkali is used as the refinement method, subsequent washing with water, to remove any unreacted excess alkali and the small amount of soap formed from the excess fatty acid neutralized by the alkali, is strongly preferred before using the product as a lubricant and/or base stock according to this invention.

Ester base stocks according to this invention consist essentially of at least 5, more preferably at least 10, still more preferably at least 15, % by weight of each of at least two of blending stock Types 1, 2, and 3 as defined and described above. In order to have the greatest practical value, it is preferred that the Type 1 blending stock have a viscosity of not more than 18, or preferably not more than 16, centistokes at 40° C., and for the same reason it is independently preferred that the Type 3 blending stock have a viscosity of at least 90 centistokes at 40° C. Also, it is independently preferred that a blended lubricant ester base stock according to this invention have a viscosity $V_B$ at 40° C. that has the following relationship to the viscosities $V_B$ and $V_H$ at 40° C. of the lowest and highest viscosity ones respectively of the two or three blending stocks from which the blended ester is composed:

$$(1+x)V_L \leqq V_B \leqq (1-x)V_H,$$

where x is a number and, with increasing preference in the order given, x=0.02, 0.04, 0.07, 0.10, 0.15, or 0.20. Additionally and independently, it is preferable for the blending stocks according to this invention to be selected so that a blend of any ISO grade between 22 and 68, or more preferably, any ISO grade between 16 and 100, inclusive, may be prepared from the three blending stocks.

Under some conditions of use, the ester(s) as described herein will function satisfactorily as complete lubricants. It is generally preferable, however, for a complete lubricant to contain other materials generally denoted in the art as additives, such as oxidation resistance and thermal stability improvers, corrosion inhibitors, metal deactivators, lubricity additives, viscosity index improvers, pour and/or floc point depressants, detergents, dispersants, antifoaming agents, anti-wear agents, and extreme pressure resistant additives. Many additives are multifunctional. For example, certain additives may impart both anti-wear and extreme pressure resistance properties, or function both as a metal deactivator and a corrosion inhibitor. Cumulatively, all additives preferably do not exceed 8% by weight, or more preferably do not exceed 5% by weight, of the total compounded lubricant formulation.

An effective amount of the foregoing additive types is generally in the range from 0.01 to 5% for the antioxidant component, 0.01 to 5% for the corrosion inhibitor component, from 0.001 to 0.5% for the metal deactivator component, from 0.5 to 5% for the lubricity additives, from 0.01 to 2% for each of the viscosity index improvers and pour and/or floc point depressants, from 0.1 to 5% for each of the detergents and dispersants, from 0.001 to 0.1% for anti-foam agents, and from 0.1–2% for each of the anti-wear and extreme pressure resistance components. All these percentages are by weight and are based on the total lubricant composition. It is to be understood that more or less than the stated amounts of additives may be more suitable to particular circumstances, and that a single molecular type or a mixture of types may be used for each type of additive component. Also, the examples listed below are intended to be merely illustrative and not limiting, except as described in the appended claims.

Examples of suitable oxidation resistance and thermal stability improvers are diphenyl-, dinaphthyl-, and phenylnaphthyl-amines, in which the phenyl and naphthyl groups can be substituted, e.g., N,N'-diphenyl phenylenediamine, p-octyldiphenylamine, p,p-dioctyldiphenylamine, N-phenyl-1-naphthyl amine, N-phenyl-2-naphthyl amine, N-(p-dodecyl)phenyl-2-naphthyl amine, di-1-naphthylamine, and di-2-naphthylamine; phenothazines such as N-alkylphenothiazines; imino(bisbenzyl); and hindered phenols such as 6-(t-butyl) phenol, 2,6-di-(t-butyl) phenol, 4-methyl-2,6-di-(t-butyl) phenol, 4,4'-methylenebis(-2,6-di-{t-butyl} phenol), and the like.

Examples of suitable cuprous metal deactivators are imidazole, benzamidazole, 2-mercaptobenzthiazole, 2,5-dimercaptothiadiazole, salicylidine-propylenediamine, pyrazole, benzotriazole, tolutriazole, 2-methylbenzamidazole, 3,5-dimethyl pyrazole, and methylene bis-benzotriazole. Benzotriazole derivatives are preferred. Other examples of more general metal deactivators and/or corrosion inhibitors include organic acids and their esters, metal salts, and anhydrides, e.g., N-oleyl-sarcosine, sorbitan monooleate, lead naphthenate, dodecenyl-succinic acid and its partial esters and amides, and 4-nonylphenoxy acetic acid; primary, secondary, and tertiary aliphatic and cycloaliphatic amines and amine salts of organic and inorganic acids, e.g., oil-soluble alkylammonium carboxylates; heterocyclic nitrogen containing compounds, e.g., thiadiazoles, substituted imidazolines, and oxazolines; quinolines, quinones, and anthraquinones; propyl gallate; barium dinonyl naphthalene sulfonate; ester and amide derivatives of alkenyl succinic anhydrides or acids, dithiocarbamates, dithiophosphates; amine salts of alkyl acid phosphates and their derivatives.

Examples of suitable lubricity additives include long chain derivatives of fatty acids and natural oils, such as esters, amines, amides, imidazolines, and borates.

Examples of suitable viscosity index improvers include polymethacrylates, copolymers of vinyl pyrrolidone and methacrylates, polybutenes, and styrene-acrylate copolymers.

Examples of suitable pour point and/or floc point depressants include polymethacrylates such as methacrylate-ethylene-vinyl acetate terpolymers; alkylated naphthalene derivatives; and products of Friedel-Crafts catalyzed condensation of urea with naphthalene or phenols.

Examples of suitable detergents and/or dispersants include polybutenylsuccinic acid amides; polybutenyl phosphonic acid derivatives; long chain alkyl substituted aromatic sulfonic acids and their salts; and metal salts of alkyl sulfides, of alkyl phenols, and of condensation products of alkyl phenols and aldehydes.

Examples of suitable anti-foam agents include silicone polymers and some acrylates.

Examples of suitable anti-wear and extreme pressure resistance agents include sulfurized fatty acids and fatty acid esters, such as sulfurized octyl tallate; sulfurized terpenes; sulfurized olefins; organopolysulfides; organo phosphorus derivatives including amine phosphates, alkyl acid phosphates, dialkyl phosphates, aminedithiophosphates, trialkyl and triaryl phosphorothionates, trialkyl and triaryl phosphines, and dialkylphosphites, e.g., amine salts of phosphoric acid monohexyl ester, amine salts of dinonylnaphthalene sulfonate, triphenyl phosphate, trinaphthyl phosphate, diphenyl cresyl and dicresyl phenyl phosphates, naphthyl diphenyl phosphate, triphenylphosphorothionate; dithiocarbamates, such as an antimony dialkyl dithiocarbamate; chlorinated and/or fluorinated hydrocarbons, and xanthates.

Under some conditions of operation, it is believed that the presence in lubricants of the types of polyether polyols that have been prominent constituents of most prior art lubricant base stocks taught as useful with fluorocarbon refrigerant working fluids are less than optimally stable and/or inadequately compatible with some of the most useful lubricant additives. Thus, in one embodiment of this invention, it is preferred that the lubricant base stocks and lubricants be substantially free of such polyether polyols. By "substantially free", it is meant that the compositions contain no more than about 10% by weight, preferably no more than about 2.6% by weight, and more preferably no more than about 1.2% by weight of the materials noted.

One major embodiment of the present invention is a refrigerant working fluid comprising both a suitable heat transfer fluid such as a fluorocarbon and a blended lubricant according to this invention. Preferably, the refrigerant working fluid and the blended lubricant should have chemical characteristics and be present in such a proportion to each other that the working fluid remains homogeneous, i.e., free from visually detectable phase separations or turbidity, over the entire range of working temperatures to which the working fluid is exposed during operation of a refrigeration system in which the working fluid is used. This working range may vary from −60° C. to as much as +175° C. It is often adequate if the working fluid remains single phase up to +30° C., although it is increasingly more preferable if the single phase behavior is maintained up to 40, 56, 71, 88, or 100° C. Similarly, it is often adequate if the working fluid compositions remains a single phase when chilled to 0° C., although it is increasingly more preferable if the single phase behavior persists to −10, −20, −30, −40, or −55° C. Single phase mixtures with chlorine free hydrofluorocarbon refrigerant working fluids can often be obtained with the suitable and preferred types of blended esters described above, with the most preferred blended esters most likely to give such single phase behavior over a wide temperature range. It should be noted that it is not necessary for the blending stocks themselves to exhibit such single phase behavior in order for the blends to do so. For example, the tetraester of PE with 3,5,5-trimethylhexanoic acid is almost immiscible with Refrigerant 134a, but a blend of 45% by weight of this tetraester with 55% by weight of the tetraester of PE with pentanoic acid exhibits single phase behavior with R134a over a wide temperature range.

Inasmuch as it is often difficult to predict exactly how much lubricant will be mixed with the heat transfer fluid to form a working fluid, it is most preferable if the lubricant composition forms a single phase in all proportions with the heat transfer fluid over the temperature ranges noted above. This however, is a very stringent requirement, and it is often sufficient if there is single phase behavior over the entire temperature range for a working fluid mixture containing up to 1% by weight of lubricant according to this invention. Single phase behavior over a temperature range for mixtures containing up to 2, 4, 10, and 15, or even 70 or 80, % by weight of lubricant is successively more preferable.

In some cases, single phase behavior is not required. The term "miscible" is used in the refrigeration lubrication art and hereinafter, except when part of the phrase "miscible in all proportions", when two phases are formed but are readily capable of being mixed into a uniform dispersion that remains stable as long as it is at least moderately agitated mechanically. Some refrigeration (and other) compressors are designed to operate satisfactorily with such miscible mixtures of refrigerant working fluid and lubricant. In contrast, mixtures that lead to coagulation or significant thickening and form two or more phases are unacceptable commercially and are designated herein as "immiscible". Any such mixture described below is a comparative example and not an embodiment of the present invention.

Another major embodiment of the invention is the use of a lubricant blend according to the invention, either as total lubricant or lubricant base stock, as a lubricant in a process of operating refrigerating machinery in such a manner that the lubricant is in contact with the refrigerant working fluid.

The ranges and preferred ranges of viscosity and variation of viscosity with temperature for lubricant compositions according to this invention are generally the same as established in the art for lubricants to be used in refrigeration systems together with a heat transfer fluid, particularly a fluorocarbon and/or chlorofluorocarbon heat transfer fluid. In general, it is preferred that lubricants according to this invention have International Organization for Standardization ("ISO") viscosity grade numbers between 10 and 1000. The viscosity ranges for some of the ISO viscosity grade numbers are given in Table 1.

TABLE 1

| ISO Viscosity Grade Number | Viscosity Range in Centistokes at 40° C. Minimum | Maximum |
|---|---|---|
| 2 | 1.98 | 2.42 |
| 3 | 2.88 | 3.52 |
| 5 | 4.14 | 5.06 |
| 7 | 6.12 | 7.48 |
| 10 | 9.00 | 11.0 |
| 15 | 13.5 | 16.5 |
| 22 | 19.8 | 24.2 |
| 32 | 28.8 | 35.2 |
| 46 | 41.4 | 50.6 |
| 68 | 61.2 | 74.8 |
| 100 | 90.0 | 110 |
| 150 | 135 | 165 |
| 220 | 198 | 242 |
| 320 | 288 | 352 |
| 460 | 414 | 506 |
| 680 | 612 | 748 |
| 1,000 | 900 | 1,100 |
| 1,500 | 1,350 | 1,650 |

The practice of the invention may be further understood and appreciated by consideration of the following examples and comparative examples.

General Ester Synthesis Procedure

The alcohol(s) and acid(s) to be reacted, together with a suitable catalyst such as dibutyltin diacetate, tin oxalate, phosphoric acid, and/or tetrabutyl titanate, were charged into a round bottomed flask equipped with a stirrer, thermometer, nitrogen sparging means, condenser, and a recycle trap. Acid(s) were charged in about a 15% molar excess over the alcohol(s). The amount of catalyst was from 0.02 to 0.1% by weight of the weight of the total acid(s) and alcohol(s) reacted.

The reaction mixture was heated to a temperature between about 220° and 230° C., and water from the resulting reaction was collected in the trap while refluxing acids were returned to the reaction mixture. Partial vacuum was maintained above the reaction mixture as necessary to achieve a ref lux rate of between 8 and 12% of the original reaction mixture volume per hour.

The reaction mixture was sampled occasionally for determination of hydroxyl number, and after the hydroxyl number had fallen below 15.0 mg of KOH per gram of mixture for reactions including divalent acid, or below 5.0 mg of KOH per gram of mixture for other reactions, the majority of the excess acid was removed by distillation after applying the highest vacuum obtainable with the apparatus used, corresponding to a residual pressure of about 0.05 torr, while maintaining the reaction temperature. The reaction mixture was then cooled, and any residual acidity was removed, if desired, by treatment with lime, sodium hydroxide, or epoxy esters. The resulting lubricant or lubricant base stock was dried and filtered before blending and phase compatibility testing.

General Procedure for Phase Compatibility Testing

One milliliter ("ml") of the lubricant to be tested is placed into a thermal shock resistant, volumetrically graduated glass test tube 17 millimeters ("mm") in diameter and 145 mm long. The test tube is then stoppered and placed into a cooling bath regulated to −29°±0.2° C. After the tube and contents have equilibrated in the cooling bath for 5 minutes ("min"), sufficient refrigerant working fluid is added to give a total volume of 10 ml.

At least 15 min after the working fluid has been added, during which time the tube and contents have been equilibrating in the cooling bath and the contents may have been agitated if desired, the tube contents are visually examined for evidence of phase separation. If there is any such phase separation, the tube is shaken to determine whether the combination can be rated as miscible or is totally unacceptable.

If there is no evidence of phase separation at −29° C., the temperature of the cooling bath is usually lowered at a rate of 0.30 per min until phase separation is observed. The temperature of first observation of phase separation, if within the range of the cooling equipment used, is then noted as the insolubility onset temperature.

Composition of Blending Stocks

A Type 1 blending stock as described above was prepared by reacting a mixture of alcohol molecules in which 99.4% were PE molecules, with most of the remainder being DPE molecules, with a mixture of acid molecules that included 99.6% pentanoic (=n-valeric) acid, with the remainder predominantly 2-methylbutanoic acid. This Type 1 blending stock had an ISO grade of 15.

A first Type 2 blending stock as described above, designated Type 2-1, was prepared by reacting a mixture of alcohol molecules in which 99.4% were PE molecules, with most of the remainder being DPE molecules, with a mixture of acid molecules that included 46.7% of pentanoic (=n-valeric) acid, 21.5% of 2-methylbutanoic acid, and 31.6% of 3,5,5-trimethylhexanoic acid, with the remainder predominantly other branched $C_9$ monobasic acids. This Type 2-1 blending stock had an ISO grade of 32.

A second Type 2 blending stock as described above, designated Type 2-2, was prepared by reacting a mixture of alcohol molecules in which 99.4% were PE molecules, with most of the remainder being DPE molecules, with a mixture of acid molecules that included 66.8% of pentanoic (=n-valeric) acid, 28.4% of 2-methylbutanoic acid, and 4.6% of adipic acid, with the remainder being predominantly 3-methylbutanoic acid. This Type 2-2 blending stock had an ISO grade of 32.

A first Type 3 blending stock as described above was prepared by reacting a mixture of alcohol molecules in which 99.4% are PE molecules, with most of the remainder being DPE molecules, with a mixture of acid molecules that included 61.9% of pentanoic (=n-valeric) acid, 27.8% of 2-methylbutanoic acid, and 10.2% of adipic acid, with the remainder predominantly 3-methylbutanoic acid. This Type 3 blending stock, specifically designated Type 3-1, had an ISO grade of 100.

A second Type 3 blending stock as described above was prepared by reacting a mixture of alcohol molecules in which 99.4% are PE molecules, with most of the remainder being DPE molecules, with a mixture of acid molecules that included 90% of 3,5,5-trimethylhexanoic acid, with the remainder predominantly other branched $C_9$ monobasic acids. This Type 3 blending stock, specifically designated Type 3-2, was a solid at room temperature and did not correspond to any ISO grade.

Examples of Specific Blended Esters

Examples of blended esters according to the invention that were made by blending these blending stocks are shown in Table 2.

TABLE 2

| PERCENT BY WEIGHT IN | CHARACTERISTICS OF EXAMPLE BLEND NUMBER: | | | | | | | | | |
|---|---|---|---|---|---|---|---|---|---|---|
| EXAMPLE BLEND OF: | 1 | 2 | 3 | 4 | 5 | 6 | 7 | 8 | 9 | 10 |
| Blending Stock Type 1 | 49 | 55 | 39 | 19 | 45 | | | | | |
| Blending Stock Type 2-1 | | | | | | 66 | 67 | | | |
| Blending Stock Type 2-2 | 51 | | | | | | | 67 | 61 | 37 |
| Blending Stock Type 3-1 | | | 61 | 81 | 55 | | 33 | 33 | 39 | 63 |
| Blending Stock Type 3-2 | | 45 | | | | 34 | | | | |
| ISO GRADE | 22 | 32 | 46 | 68 | 32 | 46 | 46 | 46 | 50* | 68 |
| ACID VALUE | .010 | .026 | .017 | .012 | .010 | .027 | .017 | .009 | .009 | .011 |
| HYDROXYL VALUE | 5.4 | 3.1 | 4.0 | 4.1 | 4.0 | 3.9 | 3.7 | 6.2 | 6.0 | 5.3 |
| VISCOSITY IN CENTISTOKES AT: | | | | | | | | | | |
| 100° C. | 4.52 | 5.70 | 7.81 | 10.2 | 6.08 | 6.87 | 7.32 | 7.68 | 8.1 | 10.2 |
| 40° C. | 21.9 | 32.5 | 46.5 | 68.5 | 32.9 | 46.0 | 46.5 | 46.8 | 50.9 | 69.0 |
| VISCOSITY INDEX | 120 | 116 | 137 | 133 | 134 | 104 | 119 | 131 | 130 | 133 |
| FLASH POINT, °C. | 234 | 258 | 260 | 260 | 226 | 260 | 254 | 250 | 250 | 254 |
| POUR POINT, °C. | <−48 | <−48 | nd | nd | −55 | nd | nd | nd | nd | nd |

Notes for Table 2
All of the blends in this table had an incompatibility temperature with R134a that was below −57° C.
*Not an official ISO Grade.
"nd" means "not determined".

The invention claimed is:

1. A refrigerant working fluid which remains in a single phase between −55° C. and 56° C. and consisting essentially of a primary heat transfer fluid selected from chlorine-free fluoro-group-containing organic refrigerating heat transfer fluids and a balance of a composition of matter suitable for serving as a lubricant or lubricant base stock, said composition consisting essentially of a blended mixture of at least about 5% by weight of each of two blending stocks designated as Type 2 and Type 3, wherein Type 2 is an ester or mixture of esters made by reacting (i) a mixture of alcohol molecules selected from the group consisting of TMP, DTMP, PE, and DPE with (ii) a mixture of acid molecules selected from the group consisting of all the straight and branched chain monobasic and dibasic carboxylic acids with from four to twelve carbon atoms each, subject to the constraints that (a) at least about 3% of the acid molecules in the mixture are i-$C_5$ acid; (b) the ratio of the % of acid molecules in the mixture that contain 8 or more carbon atoms and are unbranched to the % of acid molecules that are both branched and contain not more than six carbon atoms is not greater than about 1.56; (c) the % of acid molecules in the mixture that contain at least nine carbon atoms, whether branched or not, is not greater than about 81; (d) at least about 20% of the acid molecules in the mixture are one of the trimethyl hexanoic acids; and (e) not more than about 14% of the carboxyl groups in the acid mixture are part of dibasic acids and not more than 2% of the carboxyl groups in the acid mixture are part of acid molecules with more than two carboxyl groups each; and Type 3 are esters or mixtures of esters made by reacting (i) a mixture of alcohol molecules selected from the group consisting of TMP, DTMP, PE, DPE, TPE and TTMP with (ii) a mixture of acid molecules selected from the group consisting of all the straight or branched chain monobasic carboxylic acids with five to six carbon atoms each, the singly and multiply branched chain monobasic carboxylic acids with from seven to thirteen carbon atoms each, and the dibasic carboxylic acids with from four to ten carbon atoms each, subject to the group of constraints that (a)(1) not more than about 14% of the carboxyl groups in the acid mixture are part of dibasic acids; (a)(2) at least about 82% of the carboxyl groups in the acid mixture are part of monobasic acids containing at least nine carbon atoms and at least one branch; and (a)(3) at least about 60% of the carboxyl groups in the acid mixture are part of trimethyl hexanoic acid molecules.

2. A refrigerant working fluid according to claim 1, which remains in a single phase between −55° C. and 56° C. and consisting essentially of a primary heat transfer fluid selected from chlorine-free fluoro-group-containing organic refrigerating heat transfer fluid and a balance of a composition of matter suitable for serving as a lubricant or lubricant base stock, said composition consisting essentially of a blended mixture of at least about 5% by weight of each of the blending stocks designated as Type 2 and Type 3 that are further defined as follows:

Type 2 is made by reacting (i) a mixture of alcohol molecules selected from the group consisting of TMP, DTMP, PE and DPE in which at least about 75% of the hydroxyl groups in the mixture are part of PE molecules with (ii) a mixture of acid molecules selected from the group consisting of all the straight and branched chain monobasic and dibasic carboxylic acids with from four to twelve carbon atoms each, subject to the constraints that (a) at least about 3% of the acid molecules in the mixture are i-$C_5$ acid; (b) the ratio of the % of acid molecules in the mixture that contain 8 or more carbon atoms and are unbranched to the % of acid molecules in the mixture that are both branched and contain not more than six carbon atoms is not greater than about 1.21; (c) the % of acid molecules in the mixture that contain at least nine carbon atoms, whether branched or not, is not greater than about 67; (d)(1) at least about 29% of the acid molecules in the mixture are one of the trimethyl hexanoic acids; not more than about 10% of the carboxyl groups in the acid mixture are part of dibasic acids; and not more than 2% of the carboxyl groups in the acid mixture are part of acid molecules with more than two carboxyl groups each; and Type 3 is an ester or mixture of esters made by reacting (i) a mixture of alcohol molecules selected from the group consisting of TMP, DTMP, PE, DPE, TPE and TTMP in which a total of at least about 75% of the hydroxyl groups in the mixture are part of PE or DPE molecules with (ii) a mixture of acid molecules selected from the group consisting of all the straight and branched chain monobasic carboxylic acids with five or six carbon atoms each, the singly and multiply branched chain monobasic carboxylic acids with from seven to thirteen carbon atoms each and the dibasic carboxylic acids with from four to ten carbon atoms each, subject to the group of constraints that (a)(1) not more than about 10% of the carboxyl groups in the acid mixture are part of dibasic acids; (a)(2) at least about 82% of the carboxyl groups in the acid mixture are part of monobasic acids containing at least nine carbon atoms and at least one branch; and (a)(3) at least about 71% of the carboxyl groups in the acid mixture are part of trimethyl hexanoic acid molecules; and at least 60% of the carboxyl groups in the acid mixture are part of 3,5,5-trimethylhexanoic acid molecules.

3. A refrigerant working fluid according to claim 2 which remains in a single phase between −55° C. and 56° C. and consisting essentially of a primary heat transfer fluid selected from chlorine-free fluoro-group-containing organic refrigerating heat transfer fluids and a balance of a composition of matter suitable for serving as a lubricant or lubricant base stock, said composition consisting essentially of a blended mixture of at least about 5% by weight of each of the blending stocks designated as Type 2 and Type 3 which are further defined as follows:

Type 2 is an ester or mixture of esters made by reacting (i) a mixture of alcohol molecules selected from the group consisting of TMP, DTMP, PE and DPE in which at least about 85% of the hydroxyl groups in the mixture are part of PE molecules with (ii) a mixture of acid molecules selected from the group consisting of all the straight and branched chain monobasic and dibasic carboxylic acids with from four to twelve carbon atoms each, subject to the constraints that (a) at least about 7% of the acid molecules in the mixture are i-$C_5$ acid; (b) the ratio of the % of acid molecules in the mixture that contain 8 or more carbon atoms and are unbranched to the % of acid molecules in the mixture that are both branched and contain not more than six carbon atoms is not greater than 1.00; (c) the % of acid molecules in the mxiture that contain at least nine carbon atoms, whether branched or not, is not greater than about 67; and (d)(1) at least about 35% of the acid molecules in the mixture are one of the trimethyl hexanoic acids; not more than about 3% of the carboxyl groups in the acid mixture are part of dibasic acids; and not more than 1% of the carboxyl groups in the acid mixture are part of acid molecules with more than two carboxyl groups each; and Type 3 is an ester or mixture of esters made by reacting (i) a mixture of alcohol molecules selected from the group consisting of TMP, DTMP, PE, DPE, TPE and TTMP in which a total of at least about 85% of the hydroxyl groups in the mixture are part of PE or DPE molecules with (ii) a mixture of acid molecules selected from the group consisting of all the straight or branched chain monobasic carboxylic acids with five to six carbon atoms each, the singly and multiply branched chain monobasic carboxylic acids with from seven to thirteen carbon atoms each, and the dibasic carboxylic acids with from four to ten carbon atoms each, subject to the group of constraints that acid molecules selected from the singly and multiply branched chain monobasic carboxylic acids with from seven to thirteen carbon atoms each subject to the constraints that (a)(1) not more than about 7% of the carboxyl groups in the acid mixture are part of dibasic acids; (a)(2) at least about 82% of the carboxyl groups in the acid mixture are part of monobasic acids containing at least nine carbon atoms and at least one branch; and (a)(3) at least about 71% of the carboxyl groups in the acid mixture are part of trimethyl hexanoic acid molecules and at least about 71% of the carboxyl groups in the acid mixture are part of 3,5,5-trimethylhexanoic acid molecules.

4. A refrigerant working fluid according to claim 3 which remains in a single phase between −55° C. and 56° C. and consisting essentially of a primary heat transfer fluid selected from chlorine-free fluoro-group-containing organic refrigerating heat transfer fluids and a balance of a composition of matter suitable for serving as a lubricant or lubricant base stock, said composition consisting essentially of a blended mixture of at least about 5% by weight of each of the blending stocks designated as Type 2 and Type 3 which are further defined as follows:

Type 2 is an ester or mixture of esters made by reacting (i) a mixture of alcohol molecules selected from the group consisting of TMP, DTMP, PE and DPE in which at least about 85% of the hydroxyl groups in the mixture are part of PE molecules with (ii) a mixture of acid molecules selected from the group consisting of all the straight and branched chain monobasic and dibasic carboxylic acids with from four to twelve carbon atoms each, subject to the constraints that (a) at least about 10% of the acid molecules in the mixture are i-$C_5$ acid; (b) the ratio of the % of acid molecules in the mixture that contain eight or more carbon atoms and are unbranched to the % of acid molecules in the mixture that are both branched and contain not more than 6 carbon atoms is not greater than 1.00; (c) the % of acid molecules in the mixture that contain at least nine carbon atoms, whether branched or not, is not greater than about 67; and (d)(1) at least about 35% of the acid molecules in the mixture are one of the trimethyl hexanoic acids; not more than about 1% of the carboxyl groups in the acid mixture are part of dibasic acids; and not more that 0.5% of the carboxyl groups in the acid mixture are part of acid molecules with more than two carboxyl groups each; and Type 3 is an ester or mixture of esters made by reacting (i) a mixture of alcohol molecules selected from the group consisting to TMP, DTMP, PE, DPE, TPE and TTMP in which a total of at least about 90% of the hydroxyl groups in the mixture are part of PE or DPE molecules with (ii) a mixture of acid molecules selected from the group consisting of all the straight or branched chain monobasic carboxylic acids with five to six carbon atoms each, the singly and multiply branched chain monobasic carboxylic acids with from seven to thirteen carbon atoms each, and the dibasic carboxylic acids with from four to ten carbon atoms each, subject to the group of constraints that (a)(1) not more than about 3% of the carboxyl groups in the acid mixture are part of dibasic acids; (a)(2) at least about 82% of the carboxyl groups in the acid mixture are part of monobasic acids containing at least nine carbon atoms and at least one branch; (a)(3) at least about 71% of the carboxyl groups in the acid mixture are part of trimethyl hexanoic acid molecules and at least about 71% of the carboxyl groups in the acid mixture are part of 3,5,5-trimethylhexanoic acid molecules.

5. A refrigerant working fluid according to claim 4 which remains in a single phase between −55° C. and 56° C. and consisting essentially of a primary heat transfer fluid selected from chlorine-free fluoro-group-containing organic refrigerating heat transfer fluids and a balance of a composition of matter suitable for serving as a lubricant or lubricant base stock, said composition consisting essentially of a blended mixture of at least about 5% by weight of each of the blending stock designated as Type 2 and Type 3 which are further defined as follows:

Type 2 is an ester or mixture of esters made by reacting (i) a mixture of alcohol molecules selected from the group consisting of TMP, DTMP, PE and DPE in which at least about 90% of the hydroxyl groups in the mixture are part of PE molecules with (ii) a mixture of acid molecules selected from the group consisting of all the straight and branched chain monobasic and dibasic carboxylic acids with from four to twelve carbon atoms each, subject to the constraints that (a) at least about 14% of the acid molecules in the mixture are i-$C_5$ acid; (b) the ratio of the % of acid molecules in the mixture that contain eight or more carbon atoms and are unbranched to the % of acid molecules in the mixture that are both branched and contain not more than 6 carbon atoms is not greater than 1.00; (c) the % of acid molecules in the mixture that contain at least nine carbon atoms, whether branched or not is not greater than about 49; and (d)(1) at least about 41% of the acid molecules in the mixture are one of the trimethyl hexanoic acids; not more than about 0.4% of the carboxyl groups in the acid mixture are part of dibasic acids; and not more than 0.5% of the carboxyl groups in the acid mixture are part of acid molecules with more than two carboxyl groups each; and Type 3 is an ester or mixture of esters made by reacting (i) a mixture of alcohol molecules selected from the group consisting of TMP, DTMP, PE, DPE, TPE and TTMP in which a total of about 98% of the hydroxyl groups in the mixture are part of PE or DPE molecules, in which 80% are PE molecules with (ii) a mixture of acid molecules selected from the group consisting of all the straight or branched chain monobasic carboxylic acids with five to six carbon atoms each, the singly and multiply branched chain monobasic carboxylic acids with from seven to thirteen carbon atoms each, and the dibasic carboxylic acids with from four to ten carbon atoms each, subject to the group of constraints that (a)(1) not more than about 0.4% of the carboxyl groups in the acid mixture are part of dibasic acids; (a)(2) at least about 82% of the carboxyl groups in the acid mixture are part of monobasic acids containing at least nine carbon atoms and at least one branch; (a)(3) at least about 71% of the carboxyl groups in the acid mixture are part of trimethyl hexanoic acid molecules;

and at least 71% of the carboxyl groups in the acid mixture are part of 3,5,5-trimethyl-hexanoic acid molecules.

6. A refrigerant working fluid according to claim 1 which remains in a single phase between −55° C. and 56° C. and consisting essentially of a primary heat transfer fluid selected from chlorine-free fluoro-group-containing organic refrigerating heat transfer fluids and a balance of a composition of matter suitable for serving as a lubricant or lubricant base stock, wherein the composition contains at least 10% by weight of Type 2 and Type 3 blending stocks and has a viscosity with an ISO grade between 16 and 100.

7. A refrigerant working fluid according to claim 1 wherein the composition of matter contains at least 15% by weight of Type 2 blending stock which has a viscosity ranging from approximately ISO grades 32 to 46 and at least 15% by weight of Type 3 blending stock which has a viscosity with an ISO grade of between 22 and 68.

8. A refrigerant working fluid according to claim 5 wherein the composition of matter contains at least 15% by weight of Type 2 blending stock which has a viscosity ranging from approximately ISO grades 32 to 46 and at least 15% by weight of Type 3 blending stock which has a viscosity of at least 90 centistokes at 40° C. and wherein the composition has a viscosity Vb having both an ISO grade of between 22 and 68 and the following relationship to the viscosities V2 and V3 at 40° C. of the Type 2 and Type 3 blending stocks in which $$(1+X)V2 \leqq Vb \leqq (1-X)V3$$

where X is 0.20 and the composition contains no more than about 1.2% by weight of polyether polyols.

9. A refrigerant working fluid according to claim 1 wherein the primary heat transfer fluid comprises at least one of the group consisting of pentafluoroethane, 1,1-difluoroethane, 1,1,1-trifluoroethane, or tetrafluorothanes.

10. A refrigerant working fluid according to claim 9 wherein the primary heat transfer fluid is 1,1,1,2-tetrafluoroethane.

11. A refrigerant working fluid according to claim 2 wherein the primary heat transfer fluid comprises at least one of the group consisting of pentafluoroethane, 1,1-difluoroethane, 1,1,1-trifluoroethane, or tetrafluoroethanes.

12. A refrigerant working fluid according to claim 3 wherein the primary heat transfer fluid comprises at least one of the group consisting of pentafluoroethane, 1,1-difluoroethane, 1,1,1-trifluoroethane, or tetrafluoroethanes.

13. A refrigerant working fluid according to claim 4 wherein the primary heat transfer fluid comprises at least one of the group consisting of pentafluoroethane, 1,1-difluoroethane, 1,1,1-trifluoroethane, or tetrafluoroethanes.

14. A refrigerant working fluid according to claim 5 wherein the primary heat transfer fluid comprises at least one of the group consisting of pentafluoroethane, 1,1-difluoroethane, 1,1,1-trifluoroethane, or tetrafluoroethanes.

15. A refrigerant working fluid according to claim 1 wherein the primary heat transfer fluid is selected from the group consisting of pentafluoroethane, 1,1-difluoroethane, 1,1,1-trifluoroethanes, tetrafluoroethanes and mixtures thereof.

16. A refrigerant working fluid according to claim 2 wherein the primary heat transfer fluid is selected from the group consisting of pentafluoroethane, 1,1-difluoroethane, 1,1,1-trifluoroethane, tetrafluoroethane and mixtures thereof.

17. A process for operating a refrigerator comprising cyclic compression, liquefaction, expansion and evaporation of a heat transfer fluid, said heat transfer fluid consisting essentially of the refrigerating heat transfer fluid according to claim 1.

18. A process for operating a refrigerator comprising cyclic compression, liquefaction, expansion and evaporation of a heat transfer fluid, said heat transfer fluid consisting essentially of the refrigerating heat transfer fluid according to claim 2.

19. A process for operating a refrigerator comprising cyclic compression, liquefaction, expansion and evaporation of a heat transfer fluid, said heat transfer fluid consisting essentially of the refrigerating heat transfer fluid according to claim 3.

20. A refrigerant working fluid which remains in a single phase between −55° C. and +56° C. and consisting essentially of a primary heat transfer fluid selected from chlorine-free fluoro-group-containing organic refrigerating heat transfer fluids and a compounded lubricant consisting essentially of at least about 92% by weight of a composition of matter suitable for serving as a lubricant or lubricant base stock, said composition consisting essentially of a blended mixture of at least about 5% by weight of each of two of blending stocks designated as Type 2 and Type 3 wherein:

Type 2 is an ester or mixture of esters made by reacting (i) a mixture of alcohol molecules selected from the group consisting of TMP, DTMP, PE, and DPE with (ii) a mixture of acid molecules selected from the group consisting of all the straight and branched chain monobasic and dibasic carboxylic acids with from four to twelve carbon atoms each, subject to the constraints that (a) at least about 3% of the acid molecules in the mixture are i-$C_5$ acid; (b) the ratio of the % of acid molecules in the mixture that contain 8 or more carbon atoms and are unbranched to the % of acid molecules that are both branched and contain not more than six carbon atoms is not greater than about 1.56; (c) the % of acid molecules in the mixture that contain at least nine carbon atoms, whether branched or not, is not greater than about 81; (d) at least about 20% of the acid molecules in the mixture are one of the trimethyl hexanoic acids; and (e) not more than about 14% of the carboxyl groups in the acid mixture are part of dibasic acid and not more than 2% of the carboxyl groups in the acid mixture are part of acid molecules with more than two carboxyl groups each; and Type 3 are esters or mixtures of esters made by reacting (i) a mixture of alcohol molecules selected from the group consisting of TMP, DTMP, PE, DPE, TPE and TTMP with (ii) and a mixture of acid molecules selected from the group consisting of all the straight or branched chain monobasic carboxylic acids with five to six carbon atoms each, the singly and multiply branched chain monobasic carboxylic acids with from seven to thirteen carbon atoms each, and the dibasic carboxylic acids with from four to ten carbon atoms each, subject to the group of constraints that (a)(1) not more than about 14% of the carboxyl groups in the acid mixture are part of dibasic acids; (a)(2) at least about 82% of the carboxyl groups in the acid mixture are part of monobasic acids containing at least nine carbon atoms and at least one branch; and (a)(3) at least about 60% of the carboxyl groups in the acid mixture are part of trimethyl hexanoic acid molecules, and in addition to the composition of matter, a balance of one or more additives selected from the group consisting of oxidation resistance and thermal stability improvers, corrosion inhibitors, metal deactivators, lubricity additives, viscosity index improvers, pour and floc point depressants, detergents, dispersants, antifoaming agents, anti-wear agent and extreme pressure resistant additives.

21. A refrigerant working fluid which remains in a single phase between −60° C. and 175° C. and consisting essentially of a primary heat transfer fluid selected from chlorine-free fluoro-group-containing organic refrigerating heat transfer fluids and a balance of a compounded lubricant consisting essentially of at least about 92% by weight of a composition of matter suitable for serving as a lubricant or lubricant base stock, said composition consisting essentially of a blended mixture of at least about 5% by weight of each of two of blending stocks designated as Type 2 and Type 3 wherein:

Type 2 is made by reacting (i) a mixture of alcohol molecules selected from the group consisting of TMP, DTMP, PE and DPE in which at least about 75% of the hydroxyl groups in the mixture are part of PE molecules with (ii) a mixture of acid molecules selected from the group consisting of all the straight and branched chain monobasic and dibasic carboxylic acids with from four to twelve carbon atoms each, subject to the constraints that (a) at least about 7% of the acid molecules in the mixture are i-$C_5$ acid; (b) the ratio of the % of acid molecules in the mixture that contain 8 or more carbon atoms and are unbranched to the % of acid molecules in the mixture that are both branched and contain not more than six carbon atoms is not greater than about 1.21; (c) the % of acid molecules in the mixture that contain at least nine carbon atoms, whether branched or not, is not greater than about 67; (d)(1) at least about 29% of the acid molecules in the mixture are one of the trimethyl hexanoic acids; not more than about 10% of the carboxyl groups in the acid mixture are part of dibasic acids; and not more than 2% of the carboxyl groups in the acid mixture are part of acid molecules with more than two carboxyl groups each; and Type 3 is an ester or mixture of esters made by reacting (i) a mixture of alcohol molecules selected from the group consisting of TMP, DTMP, PE, DPE, TPE and TTMP in which a total of at least about 75% of the hydroxyl groups in the mixture are part of PE or DPE molecules with (ii) a mixture of acid molecules selected from the group consisting of all the straight and branched chain monobasic carboxylic acids with five or six carbon atoms each, the singly and multiply branched chain monobasic carboxylic acids with from seven to thirteen carbon atoms each and the dibasic carboxylic acids with from four to ten carbon atoms each, subject to the group of constraints that (a)(1) not more than about 10% of the carboxyl groups in the acid mixture are part of dibasic acids; (a)(2) at least about 82% of the carboxyl groups in the acid mixture are part of monobasic acids containing at least nine carbon atoms and at least one branch; and (a)(3) at least about 71% of the carboxyl groups in the acid mixture are part of trimethylhexanoic acid molecules; and at least 60% of the carboxyl groups in the acid mixture are part of 3,5,5-trimethyl hexanoic acid molecules.

* * * * *